US005503458A

United States Patent [19]

Petrie

[11] Patent Number: 5,503,458

[45] Date of Patent: Apr. 2, 1996

[54] PORTABLE INFANT SEAT

[75] Inventor: Aidan J. Petrie, Providence, R.I.

[73] Assignee: Item New Product Development, Inc., Providence, R.I.

[21] Appl. No.: 86,950

[22] Filed: Jul. 2, 1993

[51] Int. Cl.[6] ..... A47C 7/02

[52] U.S. Cl. ..... 297/452.13; 297/37; 297/51; 297/16.1

[58] Field of Search ..... 297/46, 51, 16.1, 297/19, 219.12, 229, 255, 440.11, 452.13, DIG. 11, 18, 32, 33, 42, 37

[56] References Cited

U.S. PATENT DOCUMENTS

| | | | |
|---|---|---|---|
| 1,885,269 | 11/1932 | Kraner | 297/51 |
| 2,365,003 | 12/1944 | Reinholz | 155/11 |
| 2,603,274 | 7/1952 | McClernon | 297/37 |
| 2,679,282 | 5/1954 | Anderegg | 155/11 |
| 2,713,890 | 7/1955 | Mack | 297/452 B X |
| 2,848,040 | 8/1958 | Chernivsky | 155/189 |
| 3,017,220 | 1/1962 | Chernivsky | 297/390 |
| 3,110,519 | 6/1963 | Chernivsky | 297/285 |
| 3,235,306 | 2/1966 | Chernivsky | 297/296 |
| 3,292,830 | 12/1966 | Mack | 297/440.11 X |
| 4,081,869 | 4/1978 | Ash | 5/101 |
| 4,188,678 | 2/1980 | Rawolle | 5/101 |
| 4,553,786 | 11/1985 | Lockett, III et al. | 297/250 |
| 5,069,503 | 12/1991 | Martinez | 297/37 X |
| 5,269,591 | 12/1993 | Miga, Jr. et al. | 297/51 X |

FOREIGN PATENT DOCUMENTS

| | | | |
|---|---|---|---|
| 126964 | 12/1984 | European Pat. Off. | 297/16.1 |

*Primary Examiner*—Laurie K. Cranmer
*Attorney, Agent, or Firm*—John E. Reilly

[57] ABSTRACT

A portable infant chair includes upper and lower resilient wire frame members. The upper frame member is made up of a back and seat support portion and a lower leg support portion, and the lower frame member is made up of a ground-engaging portion with opposite sides terminating in upwardly and rearwardly inclined portions. Rotational connectors secure upper extremities of the inclined portions to the upper frame member such that the sides of the lower frame member are selectively movable between erect and collapsed orientations. The sides of the lower frame member fold inwardly in crossed overlying relation to one another against the upper frame member in the collapsed orientation. A cross member includes one end pivotally connected to a rearward end of a first of the sides and an opposite end provided with a clip for detachable engagement with either a latch bracket on a rearward end of a second of the sides in an erect orientation or alternatively with the first side in a collapsed orientation. A fabric covering positioned over the upper frame member includes a seat pocket portion having a restraining strap secured by cooperating hook and loop pile fasteners.

34 Claims, 2 Drawing Sheets

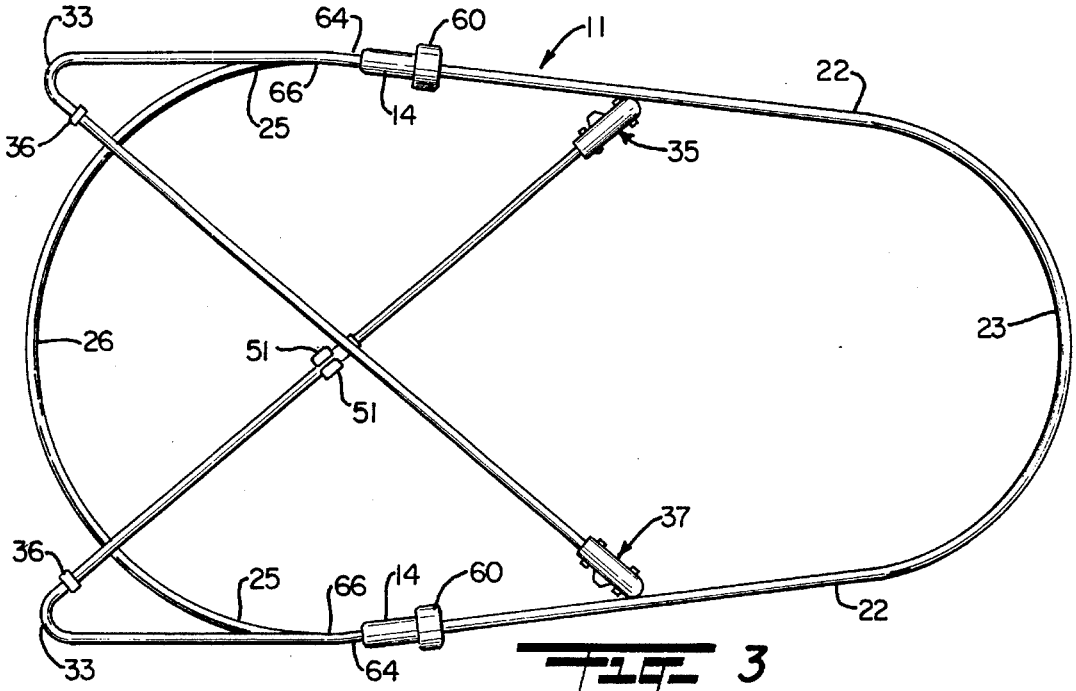
FIG. 3
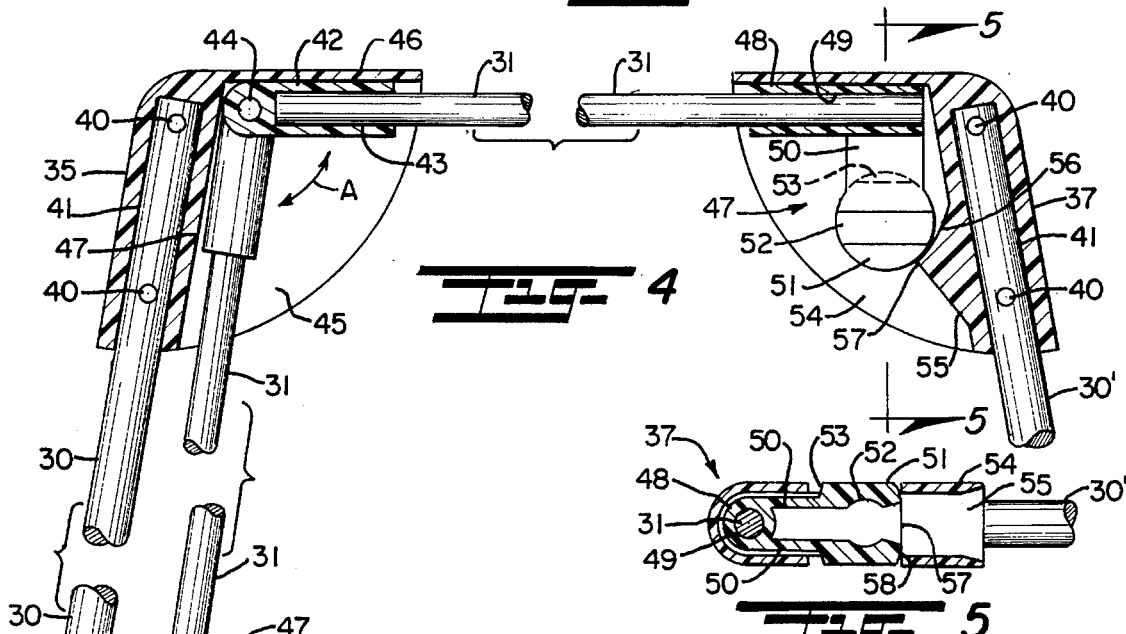
FIG. 4
FIG. 5
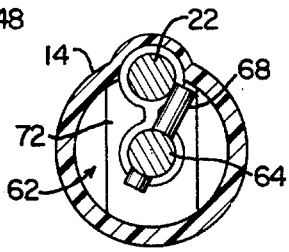
FIG. 7
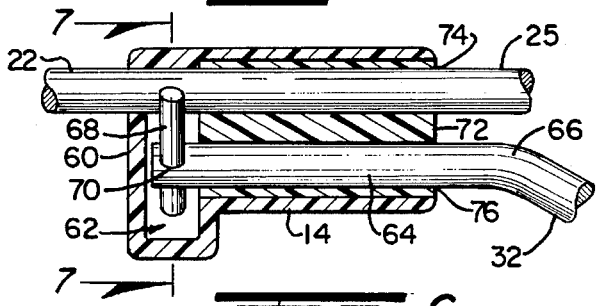
FIG. 6

PORTABLE INFANT SEAT

BACKGROUND OF THE INVENTION

The present invention relates to infant chairs or seats, and more particularly pertains to an improved infant chair of the type having an infant or child supporting fabric cover over a tubular or resilient wire frame. One example of a chair of this type is disclosed in U.S. Pat. No. 4,553,786, which issued to William Lockett, III et al. on Nov. 19, 1985, the entire disclosure of which is incorporated by reference herein. The chair disclosed in U.S. Pat. No. 4,553,786 includes a lower frame member provided with opposite sides connected at rearward ends by a removable cross member. A pair of connector flanges detachably connect terminal upper ends of inclined portions of the opposite sides of the lower frame member with an upper cover supporting frame. Thus, removal of the cross member and opposite sides results in a minimum volume configuration of the chair for purposes of transportation and storage. However, such disassembly results in multiple separate components apt to become lost, and also necessitates somewhat inconvenient reassembly of the separate components prior to use of the chair.

SUMMARY OF THE INVENTION

Accordingly, it is therefore an object of the present invention to provide for a novel and improved infant chair which is easily collapsible for purposes of transportation and storage.

It is another object of the present invention to provide for a novel and improved infant chair wherein novel connector mechanisms allow side frame members to fold inwardly to a collapsed orientation for purposes of transportation and storage.

It is a further object of the present invention to provide for a novel and improved infant chair possessing a pivotal frame cross member easily and rapidly movable between collapsed and erect orientations, without separation of the cross member from the chair frame.

It is yet another object of the present invention to provide for an infant chair possessing a novel and improved latch mechanism for detachably securing chair frame members.

It is a still further object of the present invention to provide for an infant chair possessing a novel and improved latch mechanism for detachably securing chair frame members in an erect orientation and for retaining chair frame members in a collapsed orientation.

Yet another object of the present invention is the provision of an extremely durable and easily transportable infant chair susceptible of low cost manufacture and thus economically available to the consuming public.

In order to achieve these and other objects of the invention, the present invention provides an improved portable infant chair which includes upper and lower resilient wire frame members. The upper frame member includes a back and seat support portion and a lower leg support portion. The lower frame member possesses, in an erect orientation, a horizontal ground engaging portion with forwardly extending opposite sides terminating in upwardly and rearwardly inclined portions. Rotational connectors secure upper extremities of the inclined portions to the upper frame member such that the sides of the lower frame member are selectively movable between erect and collapsed orientations. The sides of the lower frame member fold inwardly in crossed overlying relation against the upper frame member in the collapsed orientation. A cross member includes one end pivotally mounted to a rearward end of a first of the sides and an opposite end provided with a clip for detachable engagement with either a latch bracket on a rearward end of a second of the sides in an erect orientation or alternatively with the first side in a collapsed orientation. The latch bracket includes spaced sidewalls possessing aligned apertures dimensioned for engagement with opposite side portions of the clip. The clip possesses spaced resilient legs, with each of the legs having a channel dimensioned for engagement with a medial portion of the first side of the lower frame member. A fabric covering positioned over the upper frame member includes a seat pocket portion having a restraining strap secured by cooperating hook and loop pile fasteners.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

FIG. 3 is a bottom plan view illustrating the frame of the infant chair in a collapsed orientation.

FIG. 4 is a detail view, partially cut away and in cross-section, illustrating pivot and latch mechanisms of the frame cross member of the infant chair of the present invention.

FIG. 5 is a cross-sectional detail view, taken along line 5—5 of FIG. 4, further illustrating the cross member latch mechanism of the infant chair of the present invention.

FIG. 6 is a detail view, partially cut away and in cross-section, illustrating a rotational connector mechanism mounting a lower frame member side portion of the infant chair of the present invention for movement between erect and collapsed orientation.

FIG. 7 is a transverse cross-sectional detail view, taken along line 7—7 of FIG. 6, further illustrating the rotational connector mechanism.

DETAILED DESCRIPTION OF THE PREFERRED EMBODIMENT(S)

Figure 1:
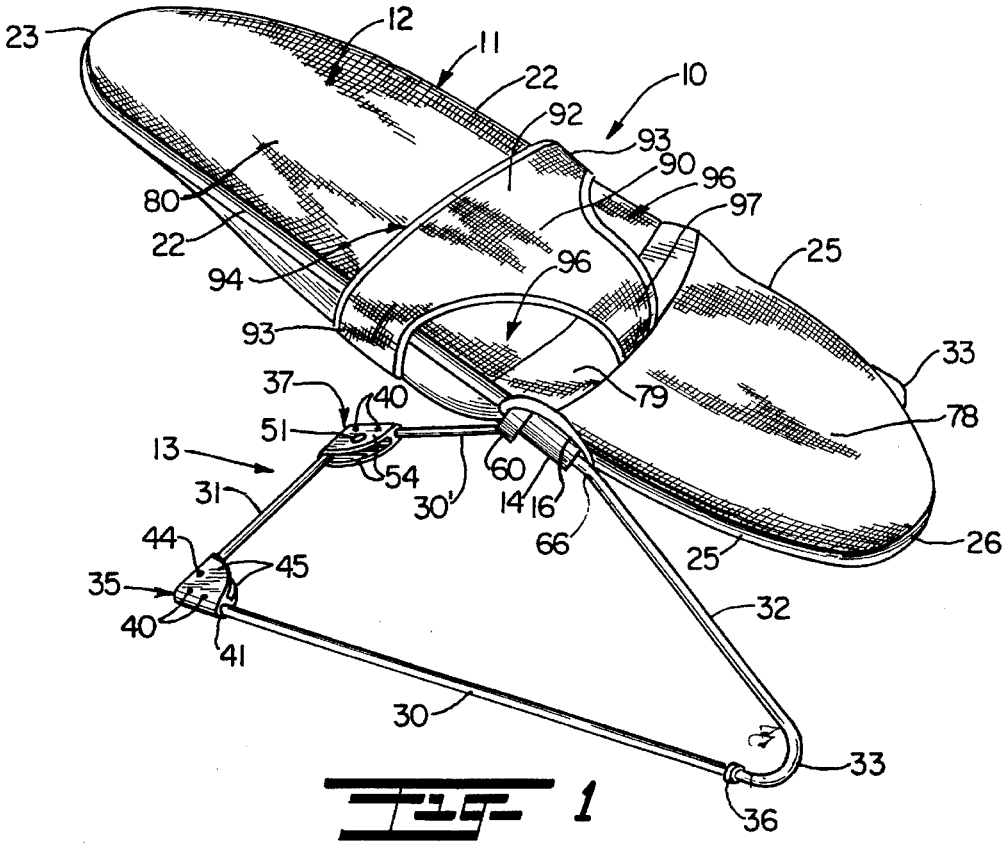
FIG. 1 is a perspective view of the infant chair according to present invention in an erect orientation.

Referring now to the drawings, wherein like reference numerals designate corresponding structure throughout the views, and referring in particular to FIG. 1, an improved infant chair 10 according to a first preferred embodiment of the invention includes a resilient upper frame member 11 provided with a flexible fabric covering 12 and resiliently supported on a lower frame member 13. Rotational connectors 14 extending partially through aligned opposite openings 16 in cover 12 interconnect frame members 11 and 13 in an erect orientation in properly angled relation.

Figure 2:
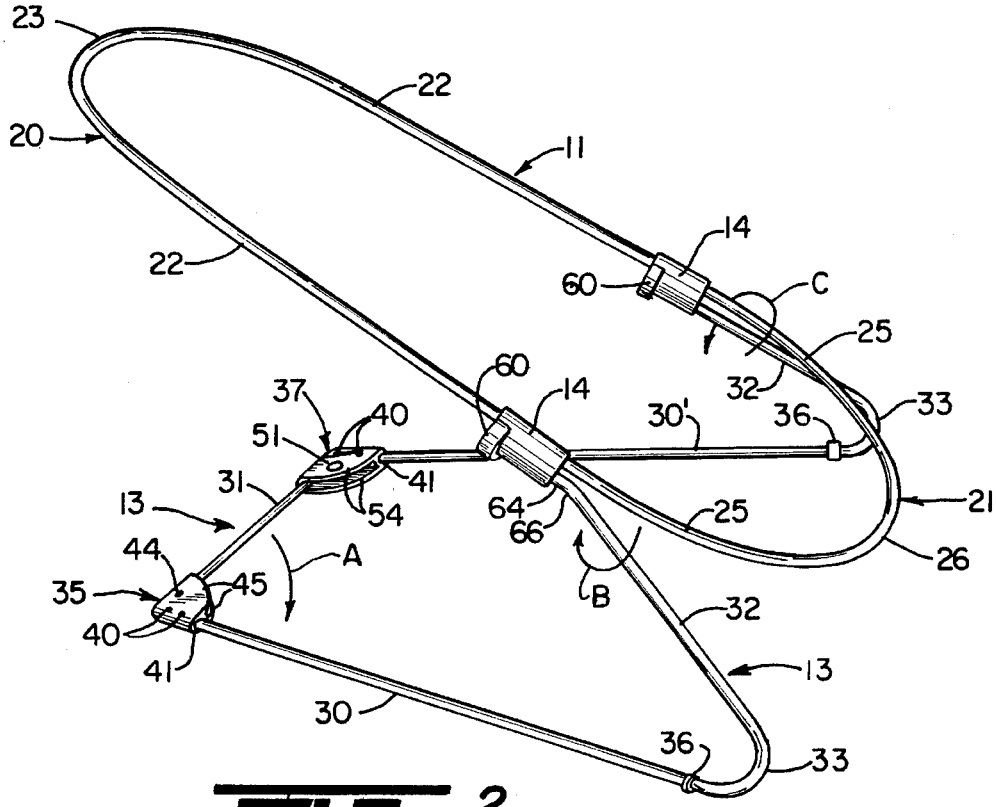
FIG. 2 is a perspective view illustrating the frame of the infant chair of the present invention in an erect orientation, with the cover removed.

FIG. 2 illustrates the configuration of the frame members 11 and 13 in an erect orientation, with the cover 12 removed. Upper frame member 11 is in the form of a one-piece solid wire or tubular construction, with a substantially U-shaped back support frame 20 formed by side members 22 joined by an upper curved section 23. The lower leg supporting frame 21 includes symmetrical side members 25 joined by a lower curved section 26.

The lower frame member 13 also may be of solid wire or tubular construction and has opposite sides 30 and 30' diverging forwardly from respective rearward ends. The forward portions of side members 30 and 30' curve upwardly and return rearwardly as at radius bends 33 to form upstanding terminal inclined portions or legs 32. A pivot bracket 35 secures one end of a rigid wire cross member 31 to a rearward end of the side 30 for pivotal movement about the axis of pivot pin 44. A latch bracket 37 detachably secures an opposite end of the cross member 31 to the other side member 30' in the erect orientation of the chair 10 depicted in FIGS. 1 and 2. Protective sleeves 36 of rubber or similar suitable material are disposed on sides 30 and 30' adjacent to bends 33 in order to protect the floor or other surface on which the chair is placed as well as to prevent slipping of the chair by virtue of frictional engagement.

With reference to FIGS. 2 and 4, the pivot bracket 35 includes a cylindrical socket 41 into which frame side member 30 is inserted and secured by rivets 40 or other conventional fasteners. The pivot bracket 35 includes spaced parallel sidewalls 45 defining an open arcuate slotted portion therebetween to receive a pivot bearing block 42 formed from a self-lubricating material, such as, Nylon, or other suitable plastic material. A cylindrical bore 43 in the pivot bearing block 42 receives one end of the cross member 31 in press-fit relation, thus substantially permanently securing cross member 31 thereto. A fixed pivot pin 44, such as a rivet or the like, extends through aligned apertures formed in proximal end of bearing block 42 and may also extend through the cross member 31 thus mounting the member 31 for reciprocal pivotal movement in the directions indicated by arc segment A. Interior end walls 46 and 47 of bracket 35 define the range of motion of pivot bearing block 42. Preferably, pivot bearing block 42 rubs lightly against interior surfaces of the sidewalls 45 of the bracket 35 such that the cross member 31 will not swing freely by virtue of gravity, but only upon application of manual force.

With reference now to FIGS. 2, 4, and 5 the latch bracket 37 includes a socket 41 which, in conjunction with rivets 40, secures the bracket 37 rigidly to the side member 30' and opposite to the pivot bracket 35. Spaced parallel sidewalls 54 of bracket 37 define an open arcuate slotted portion dimensioned to receive a clip 47 at the free end of the cross member 31 by virtue of press-fit engagement of a free end portion of the cross member 31 in a cylindrical bore 49 formed in clip stem 48. A pair of resilient legs 50, which extend transversely from the stem 48 in spaced parallel relation to one another, define a bifurcated end in the form of rounded protuberances or disks 51 which are provided with external shoulders 53. A pair of juxtaposed, spaced parallel aligned arcuate channels 52 are dispersed on inner facing surfaces of the legs 50 for the purpose of engagement with a medial portion of the side member 30 in a collapsed orientation of the chair 10, as shown in the left hand side of FIG. 4. The latch bracket 37 has inclined guide surfaces 55 and 56 intersecting at an apex 57 in order to guide the clip 47 into proper latched orientation within bracket 37 and also to retain the clip 47 against inadvertent displacement therefrom. Axially aligned circular apertures 58 are formed through opposite sidewalls 54 of the bracket 37 to receive the end portion 51 of the clip 47 in the latched condition and erect orientation of the chair 10. During movement of the cross member 31 into the latched or erect orientation, the shoulders 53 on the end portion 51 first engage outer side edge portions of sidewalls 54, causing the end portion 51 and legs 50 to spring together to an extent sufficient to allow passage of the clip 47 between the sidewalls 54. When the disks 51 engage the apertures 58, the disks 51 and legs 50 again spring to their equilibrium position, illustrated in FIG. 5. In order to collapse the chair 10, an individual may manually squeeze disks 51 together between the thumb and forefinger of one hand while pivoting the cross member 31 away from the latch bracket 37 with the other hand, until the channels 52 engage a medial portion of the opposite side member 30.

Rotational connectors 14 comprise an elongated body portion possessing a rectangular transverse cross-sectional shape having rounded opposite short side portions. A generally cylindrical radially enlarged housing portion 60 is integrally molded adjacent an upper end of each of the connectors 14. A complementary formed bushing 72 is press-fit or otherwise secured in fixed relation within the body portion of each of the connectors 14. Each of the bushings 72 includes a pair of parallel radially spaced axially extending cylindrical bores 74 and 76 extending therethrough.

As shown in FIGS. 2, 6, and 7, terminal end portions 64 of the legs 32 angle slightly downwardly and outwardly at bends 66, immediately prior to passage into the connectors 14, into substantially parallel relation to adjacent portions of the leg frame side members 25. As depicted in FIGS. 6 and 7, the solid one-piece wire forming the leg frame side members 25 and back frame side members 22 passes in press-fit substantially fixed relation through the axially aligned apertures 76 in the connector 14 and internal bushing 72. Each terminal leg end portion 64 extends for free rotation about its central longitudinal axis through the aperture 76 in the bushing 72 and into a cavity 62 in the enlarged hollow portion 60 at one end of each connector 14. A stop rod 68 extends transversely in press-fit relation through a hole 70 formed through the distal end of the terminal leg end portion 64. Abutment of the longer end portion of stop rod 68 with side member 22, as shown in FIGS. 6 and 7, establishes the erect orientation of the sides 30 and legs 32 shown in FIGS. 1 and 2.

After the cross member 31 is unlatched, pivoted in the direction of arrow A (FIG. 2) and clipped to the side member 30 as shown at the left-hand side of FIG. 4, the side members 30 may be folded or rotated inwardly as indicated by arrows B and C, FIG. 2, into crossed or intersecting relation to one another against upper frame member 11, as shown in FIG. 3, to achieve a minimum volume collapsed orientation of the chair 10 for purposes of transportation and storage.

The covering 12 of the chair 10 essentially comprises a flexible fabric bag or envelope encasing the upper frame member 11. The cover 12 includes a leg support panel 18, a seat pocket or panel 79, and a back support panel 80. A retaining fabric piece 90 includes a waist strap 92 possessing opposite free ends 93 releasably secured by suitable fasteners, not shown, such as cooperating hook and loop pile fasteners, snaps, buckles, etc., to a back face of cover 12. An enlarged central portion of retaining piece 90 tapers downwardly and inwardly to form a crotch strap 97 sewn or otherwise secured at a junction of leg support panel 78 and seat panel 79. As may now be readily appreciated, in the manner of use of the chair 10, a child's torso and legs extend, respectively, through waist opening 94 and leg openings 96. The rear surface of cover 12 preferably includes conventional fasteners such as snaps, cooperating hook and loop pile fasteners, zippers, etc., to facilitate removal and replacement of cover 12 for washing.

While the chair 10 has been illustrated and described with respect to a chair especially adapted for use by infants and children, it should be noted that chairs for adults may also be constructed within the scope of the present invention.

It is to be understood, however, that even though numerous characteristics and advantages of the present invention have been set forth in the foregoing description, together with details of the structure and function of the invention, the disclosure is illustrative only, and changes may be made in detail, especially in matters of materials, shape, size and arrangement of parts within the principles of the invention to the full extent indicated by the broad general meaning of the terms in which the appended claims are expressed and reasonable equivalents thereof.

What is claimed is:

1. A chair selectively configurable in erect and collapsed orientations, comprising:

an upper frame member including a back and seat support portion and a lower leg support portion;

a lower frame member including, in said erect orientation, a substantially horizontal ground-engaging portion with opposite sides extending forwardly from rearward ends, and upwardly and rearwardly inclined portions at forward ends of said sides of said lower frame member;

connection means connecting upper extremities of said inclined portions of said lower frame member to said back and seat and leg support portions of said upper frame member such that said back and seat support portions incline rearwardly and upwardly from their connections to said inclined portions and said leg support portion inclines forwardly from its connections to said inclined portions, said connection means mounting said opposite sides of said lower frame member for movement from said erect orientation to said collapsed orientation when said opposite sides of said lower frame member are folded inwardly in at least partially crossed overlying relation substantially against said upper frame member; and a covering positioned over said back and seat support portion and said leg support portion.

2. The chair of claim 1, further comprising a cross member extending between said rearward ends of said opposite sides of said lower frame member when said chair is disposed in said erect orientation.

3. The chair of claim 2, further comprising means for detachably securing said cross member to at least one of said rearward ends.

4. The chair of claim 3, further comprising retaining means for retaining said cross member in adjacent relation to one of said opposite sides of said lower frame member when said chair is disposed in said collapsed orientation.

5. The chair of claim 4, wherein said retaining means comprises a clip.

6. The chair of claim 2, wherein said cross member includes first and second opposite ends and further comprising means for detachably securing said first end of said cross member to one of said rearward ends and means pivotally securing said second end of said cross member to the other of said rearward ends.

7. The chair of claim 6, further comprising retaining means for retaining said cross member in adjacent relation to one of said opposite sides of said lower frame member when said chair is disposed in said collapsed orientation.

8. The chair of claim 7, wherein said retaining means comprises a clip.

9. The chair of claim 8, wherein said clip at least partially forms said means for detachably securing said first end of said cross member to one of said rearward ends.

10. The chair of claim 9, wherein said means for detachably securing said first end of said cross member to one of said rearward ends comprises:

a latch bracket secured to said one of said rearward ends; and said clip dimensioned for releasable engagement with said latch bracket.

11. The chair of claim 10, wherein said latch bracket includes spaced sidewalls having aligned apertures dimensioned for engagement with opposite side portions of said clip.

12. The chair of claim 11, wherein said clip includes spaced legs resiliently connected for movement together and apart for disengaging and engaging said opposite side portions of said clip with said aligned apertures in said latch bracket.

13. The chair of claim 12, wherein each of said legs of said clip possesses a channel dimensioned for engagement with one of said opposite sides of said lower frame member.

14. The chair of claim 1, wherein each of said connection means includes a first portion secured to said upper frame member and a second portion receiving one of said upper extremities of said inclined portions of said lower frame member.

15. The chair of claim 1, wherein said connection means includes stop means defining erect orientations of said opposite sides of said lower frame member.

16. A chair selectively configurable in erect and collapsed orientations, comprising:

a frame including opposite side members;

a cross member including first and second opposite ends;

means for detachably securing said first end of said cross member to one of said side members;

means for pivotally securing said second end of said cross member to the other of said side members whereby said cross member may be selectively connected between said side members to retain said chair in said erect orientation; and retaining means for retaining said cross member in adjacent relation to one of said opposite sides members when said chair is disposed in said collapsed orientation, said retaining means at least partially forming said means for detachably securing said first end of said cross member to one of said side members.

17. The chair of claim 16, wherein said retaining means comprises a clip.

18. The chair of claim 16, wherein said means for detachably securing said first end of said cross member to one of said side members comprises:

a latch bracket secured to said one of said side members, and a clip on said first end of said cross member dimensioned for releasable engagement with said latch bracket.

19. The chair of claim 18, wherein said latch bracket includes spaced sidewalls possessing aligned apertures dimensioned for engagement with opposite side portions of said clip.

20. The chair of claim 19, wherein said clip includes spaced legs resiliently connected for movement together and apart for engaging and disengaging said opposite side portions of said clip with said aligned apertures in said latch bracket.

21. The chair of claim 20, wherein each of said legs of said clip includes a channel dimensioned for engagement with one of said side members.

22. The chair of claim 16, further comprising means rotationally mounting said opposite side members for selective movement between said erect and collapsed orientations.

23. The chair of claim 22, wherein said rotational mounting means includes stop means defining erect orientations of said opposite sides members.

24. The chair of claim 22, wherein said opposite side members are disposed in spaced relation to one another in said erect orientation and in at least partially intersecting relation to one another in said collapsed orientation.

25. A chair selectively configurable in erect and collapsed orientations, comprising:

an upper frame member including a back and seat support portion and a lower leg support portion;

a lower frame member including, in said erect orientation, a substantially horizontal ground-engaging portion with opposite sides extending forwardly from rearward ends, and upwardly and rearwardly inclined portions at forward ends of said sides of said lower frame member;

rotational connection means rotationally connecting upper extremities of said inclined portions of said lower frame member to said back and seat and leg support portions of said upper frame member such that said back and seat support portions incline rearwardly and upwardly from their connections to said inclined portions and said leg support portion inclines forwardly from its connections to said inclined portions, whereby said opposite sides of said lower frame member are selectively movable between said erect orientation and said collapsed orientation in which said opposite sides of said lower frame member rotate upwardly into a position substantially against said upper frame member;

said rotational connecting means including stop means defining erect orientations of said opposite sides of said lower frame member;

a cross member including first and second opposite ends;

a latch bracket detachably securing said first end of said cross member to one of said rearward ends when said chair is disposed in said erect orientation, said latch bracket including spaced sidewalls possessing aligned apertures;

a pivot bracket pivotally securing said second end of said cross member to the other of said rearward ends;

a clip secured to said first end of said cross member, said clip including mounted protuberances disposed on spaced legs resiliently connected for movement together and apart for disengaging and engaging said protuberances with said aligned apertures in said latch bracket, each of said legs of said clip possessing a bifurcated end portion dimensioned for engagement with one of said opposite sides of said lower frame member for retaining said cross member in adjacent relation to said one of said opposite sides of said lower frame member when said chair is disposed in said collapsed orientation; and a covering positioned over said back and seat support portion and said leg support portion.

26. In a chair including first and second relatively movable frame members selectively configurable in erect and collapsed orientations, the improvement comprising:

a latch bracket detachably securing said first frame member to said second frame member when said chair is disposed in said erect orientation, said latch bracket including spaced sidewalls with aligned apertures therein; and a clip secured to said first frame member, said clip including spaced legs resiliently interconnected for movement into and out of alignment with said aligned apertures in said latch bracket, each of said legs of said clip having a bifurcated end portion dimensioned for engagement with a portion of said chair for retaining said first frame member in adjacent relation to said chair when said chair is disposed in said collapsed orientation.

27. The chair of claim 26, wherein said latch bracket includes oppositely inclined guide surfaces intersecting along an apex line for directing said clip into said latch bracket and retaining said clip in latched engagement.

28. The chair of claim 26, wherein said spaced legs include rounded protuberances insertable into said apertures.

29. The chair of claim 26, wherein said rounded protuberances comprise substantially cylindrical disk-shaped portions.

30. The chair of claim 26, further comprising means mounting at least one of said first and second frame members for rotational movement between erect and collapsed orientation.

31. A chair selectively configurable in erect and collapsed orientations, comprising:

a frame including opposite side members;

a cross member including first and second opposite ends;

a fastener for detachably securing said first end of said cross member to one of said side members;

a bracket pivotally securing said second end of said cross member to the other of said side members whereby said cross member may be selectively connected between said side members to retain said chair in said erect orientation; and a retainer for retaining said cross member in adjacent relation to one of said opposite sides members when said chair is disposed in said collapsed orientation, said retainer at least partially forming said fastener for detachably securing said first end of said cross member to one of said side members.

32. A chair selectively configurable in erect and collapsed orientations, comprising:

a frame including opposite side members;

a cross member including first and second opposite ends;

a latch bracket including a pair of spaced sidewalls possessing aligned apertures, said latch bracket secured to one of said side members, and a clip on said first end of said cross member dimensioned for releasable engagement with said latch bracket, opposite side portions of said clip engageable with said apertures in said latch bracket, such that said first end of said cross member may be selectively detachably secured to one of said side members; and a pivot bracket pivotally securing said second end of said cross member to the other of said side members whereby said cross member may be selectively connected between said side members to retain said chair in said erect orientation.

33. The chair of claim 32, wherein said clip includes spaced legs resiliently connected for movement together and apart for engaging and disengaging said opposite side portions of said clip with said aligned apertures in said latch bracket.

34. The chair of claim 33, wherein each of said legs of said clip includes a channel dimensioned for engagement with one of said side members.

* * * * *